US007818833B2

(12) United States Patent
Ewing

(10) Patent No.: US 7,818,833 B2
(45) Date of Patent: Oct. 26, 2010

(54) TRANSFORMABLE AND REMOVABLE BED COVERING

(76) Inventor: Regena G Ewing, 507 Wynbrooke Pkwy., Stone Mountain, GA (US) 30087

( * ) Notice: Subject to any disclaimer, the term of this patent is extended or adjusted under 35 U.S.C. 154(b) by 155 days.

(21) Appl. No.: 12/119,392

(22) Filed: May 12, 2008

(65) Prior Publication Data

US 2009/0276956 A1 Nov. 12, 2009

(51) Int. Cl.
*A47G 9/10* (2006.01)

(52) U.S. Cl. ..... 5/413 R; 5/494; 5/498

(58) Field of Classification Search ..... 5/413 R, 5/494–498
See application file for complete search history.

(56) References Cited

U.S. PATENT DOCUMENTS 3,083,378 A * 4/1963 Pursell ..... 5/498
3,530,487 A * 9/1970 Beer ..... 5/496
3,857,124 A * 12/1974 Hadley ..... 5/496
4,413,368 A * 11/1983 Schuetze ..... 5/494
5,042,099 A * 8/1991 Brenner et al. ..... 5/502
2008/0178386 A1* 7/2008 Thompson ..... 5/485
2009/0044337 A1* 2/2009 McKee ..... 5/496

* cited by examiner

*Primary Examiner*—Michael Trettel
(74) *Attorney, Agent, or Firm*—Schmid PA

(57) ABSTRACT

Disclosed is a removable bed covering assembly including both a fitted covering and a top covering which can be converted into a sleeping bag. The top covering is secured to the bed using a fitted covering attached to the mattress of the bed. The top covering and fitted covering can be attached to each via a zipper assembly. Once the top covering is removed it can be assembled into a sleeping bag via a second zipper assembly.

19 Claims, 4 Drawing Sheets

TRANSFORMABLE AND REMOVABLE BED COVERING

TECHNICAL FIELD

The present invention relates to a removable bed covering and in greater detail the invention relates to removable bed covering which can be converted into a sleeping bag upon removal.

BACKGROUND

For many years, the practice and materials used in preparing a bed have remained substantially the same. Generally a mattress is provided with a fitted lower sheet, a tucked in upper sheet, a blanket and single piece bedspread which is draped over the bed and folded back at the front end to be doubled over the pillows to covering them as well.

Several problems are commonly experienced when sleeping in a bed having the conventional preparations. First, normal movements during sleeping often cause the bed covering to be loosened along the foot end or sides of the bed allowing drafts to enter below the bed coverings. If the conventional bed coverings do remain tucked in, they are necessarily rather binding. If two people are sleeping on the bed, it often happens that one ends up with the greater portion of the bed covering with the other simply clutching on to one side. Finally, the tedious task of making a bed having conventional bed coverings thereon is well known.

Additionally, when coverings are removed from beds for sleepovers, lounging or watching television, the coverings are cumbersome and ill-suited for such tasks and the bed looks askew with covers removed. Furthermore, coverings themselves make a poor sleeping surface for sleepovers.

Accordingly, it would advantageous to provide a covering and method for covering a bed that is both removable and aid in the making of the bed along with providing comfort to the user. Furthermore, it would be advantageous for a bed covering to serve as a temporary bed for such activities as a sleepover.

SUMMARY

The present system includes a removable bed covering system providing a top covering that converts into a sleeping bag. The top covering is secured to the bed using a fitted covering attached to the mattress of the bed. The top covering and fitted covering can be attached to each via a zipper assembly. Once the top covering is removed it can be assembled into a sleeping bag via a second zipper assembly. The zipper assemblies can be two sided.

In greater detail, the removable bed covering system of the present invention includes a fitted covering adapted to overlie a mattress having a head end. A top covering is adapted to overlie the fitted covering which overlies the mattress. A first zipper assembly secures the periphery of the fitted covering to the periphery of the top covering excluding the head end to form an envelope there between.

The top covering also includes a second zipper assembly whereby the top covering can be converted into a sleeping bag by joining the peripheral ends of the top covering via the second zipper assembly. The second zipper assembly may be located between about ⅛ to about ½ inches from the first zipper assembly attached to the top covering and in a further embodiment it is placed about ¼ of an inch from the first zipper assembly attached to the top covering. The second zipper assembly may be a two sided zipper. The top covering and fitted covering include a design and the design may be same or coordinated to match such that when the top covering is removed the bed continues to have an attractive appearance.

Furthermore, a bed skirt may be attached to the fitted covering. Also a hook and loop fastener may be attached to the fitted covering, wherein the fastener secures the covering to the mattress. The first zipper assembly may also be a two sided zipper.

A further embodiment includes a removable bed covering system having a head end a fitted covering adapted to overlie a mattress. The fitted covering includes a hook and loop fastener whereby the fastener secures the covering to the mattress. Additionally, the fitted covering includes a bed skirt.

A top covering is adapted to overlie the fitted covering. A first zipper assembly is included for securing the periphery of the fitted covering to the periphery of the top covering excluding the head end and forming an envelope there between. Additionally, a second zipper assembly is attached to the top covering whereby the top covering can be converted into a sleeping bag by joining the peripheral ends of the top covering via the second zipper assembly.

An additional embodiment includes the removable bed covering system for a mattress having a head end comprising a fitted covering adapted to overlie the mattress. The fitted covering includes a hook and loop fastener whereby the fastener secures the covering to the mattress. The top covering is adapted to overlie the fitted covering and a first zipper assembly secures the periphery of the fitted covering to the periphery of the top covering excluding the head end. The first zipper assembly can form an envelope there between.

A second zipper assembly is attached to the top covering. Once removed from the fitted covering the top covering can be converted into a sleeping bag by joining the peripheral ends of the top covering via the second zipper assembly. Of course a head end of the fitted covering is not joined to form a sleeping bag. The second zipper assembly is a two sided zipper and is located between about ⅛ to ½ inches from the first zipper assembly attached to the top covering.

DRAWINGS

DETAILED DESCRIPTION

Disclosed is a removable bed covering system providing a top covering that converts into a sleeping bag. The top covering is secured to the bed using a fitted covering attached to the mattress of the bed. The top covering and fitted covering can be attached to each other via a zipper assembly. Once the top covering is removed it can be assembled into a sleeping bag via a second zipper assembly. The zipper assemblies can be two sided.

Referring now in greater detail to the drawings in which like numerals indicate like items throughout the several views, FIGS. 1-4 depict the present removable bed covering system providing a top covering that converts into a sleeping bag, in the various embodiments of the present invention.

Figure 1:
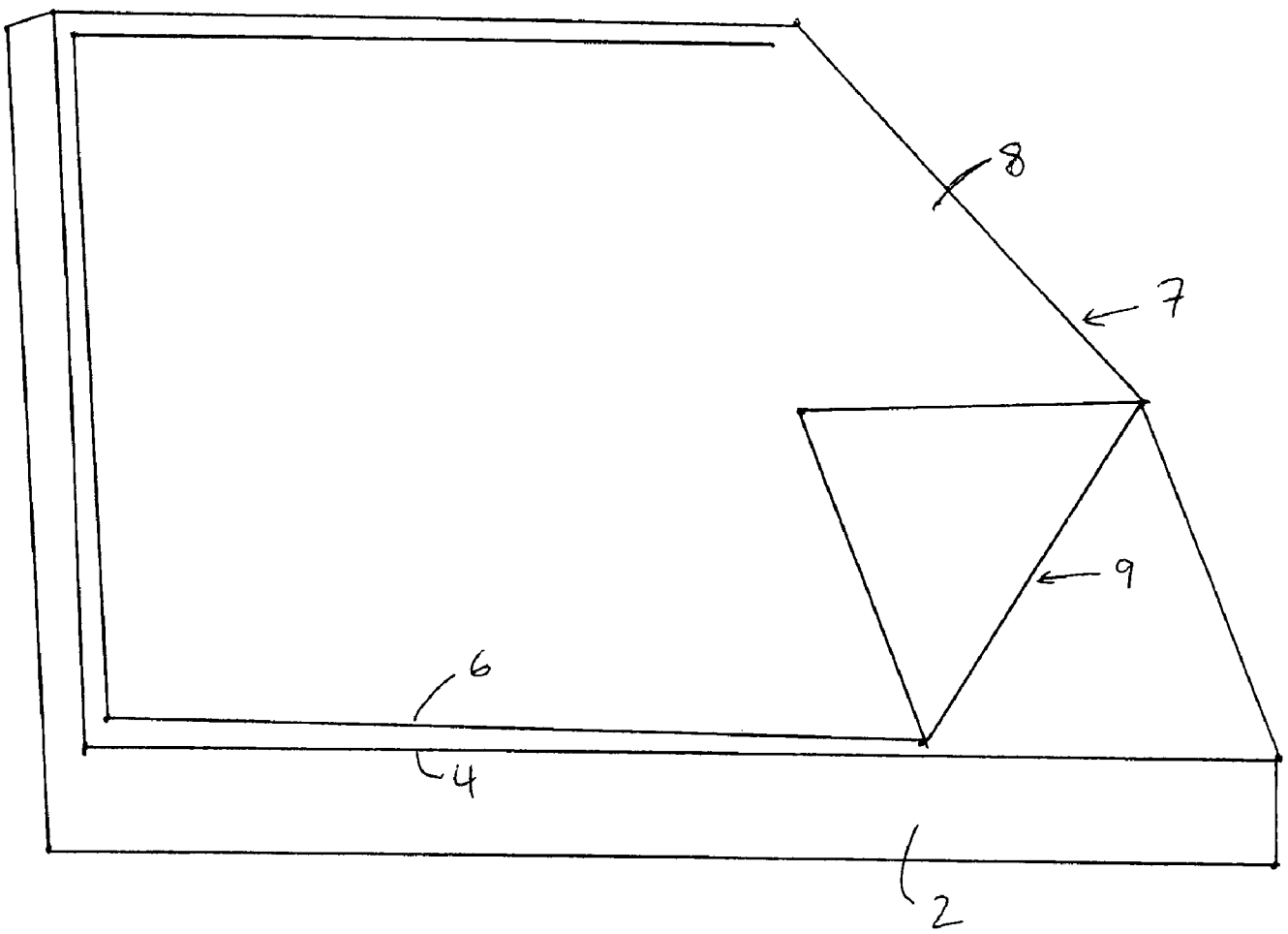
FIG. 1 is an illustration of an embodiment of the system wherein the top covering is configured showing the first zipper assembly and the second zipper assembly and wherein the top covering is attached to the fitted covering via the first zipper.

FIG. 1 illustrates of an embodiment of the present system wherein the top covering 8 is configured showing the first zipper assembly 4 and the second zipper assembly 6 and wherein the top covering 8 is attached to the fitted covering 2 via the first zipper assembly 4. The top covering 8 may be removed from the fitted covering 2 via the first zipper assembly. The fitted covering 2 is secured to the mattress 14 (shown in the cutaway view in FIG. 2) using any means known in the art, for example an elastic strap or the like. The top covering 8 is secured to the fitted covering 2 by zipping the top covering 8 to the fitted covering 2 while leaving the head end 7 open to form an envelope 9.

The top covering 8 may be most any type of covering commonly used for a bed. In one embodiment the top covering 8 is an insulating material similar to those materials comprising a sleeping bag. Furthermore, the top covering 8 may be formed from materials commonly making up comforters found on beds.

The fitted covering 2 can be made from most any material. In one embodiment the fitted covering 2 is formed from a fabric similar to those of fitted sheets.

The first zipper assembly 4 and second zipper assembly 6 may run substantially parallel to each other as shown in FIG. 1. The second zipper assembly 6 may be positioned to a distance from the first zipper assembly 4 of between about ⅛ of an inch to about ½ of an inch and in a further embodiment the distance is about ¼ inch. Of course the distance in such spacing is only limited to the desired volume of the resulting formed envelope 9 of the sleeping bag. Thus, the distance may be greater than ½ inch.

Figure 2:
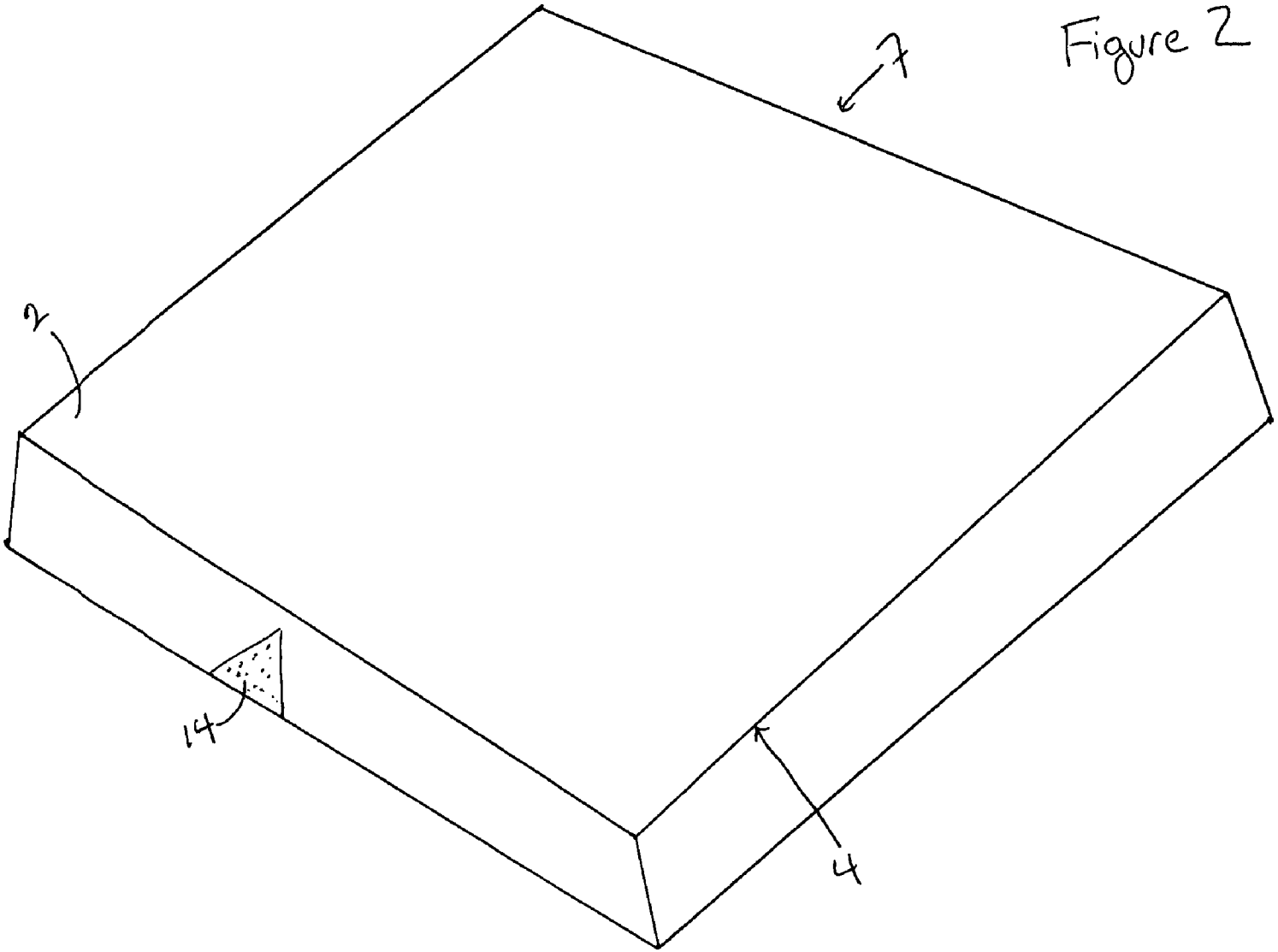
FIG. 2 depicts the fitted covering attached to a mattress and the first zipper assembly for attaching the top covering to the fitted covering.

FIG. 2 depicts the fitted covering 2 and the first zipper assembly 4. The zipper assemblies of the present system may be two sided zippers for ease of use in one embodiment. However other embodiments are contemplated wherein other zipper configurations are used. The two sided zipper configuration is advantageous in zipping the coverings from either inside the envelope 9 or outside of the envelope 9. Additionally illustrated in FIG. 2 is a cutout of the fitted covering 2 showing the mattress 14 underneath.

Figure 3:
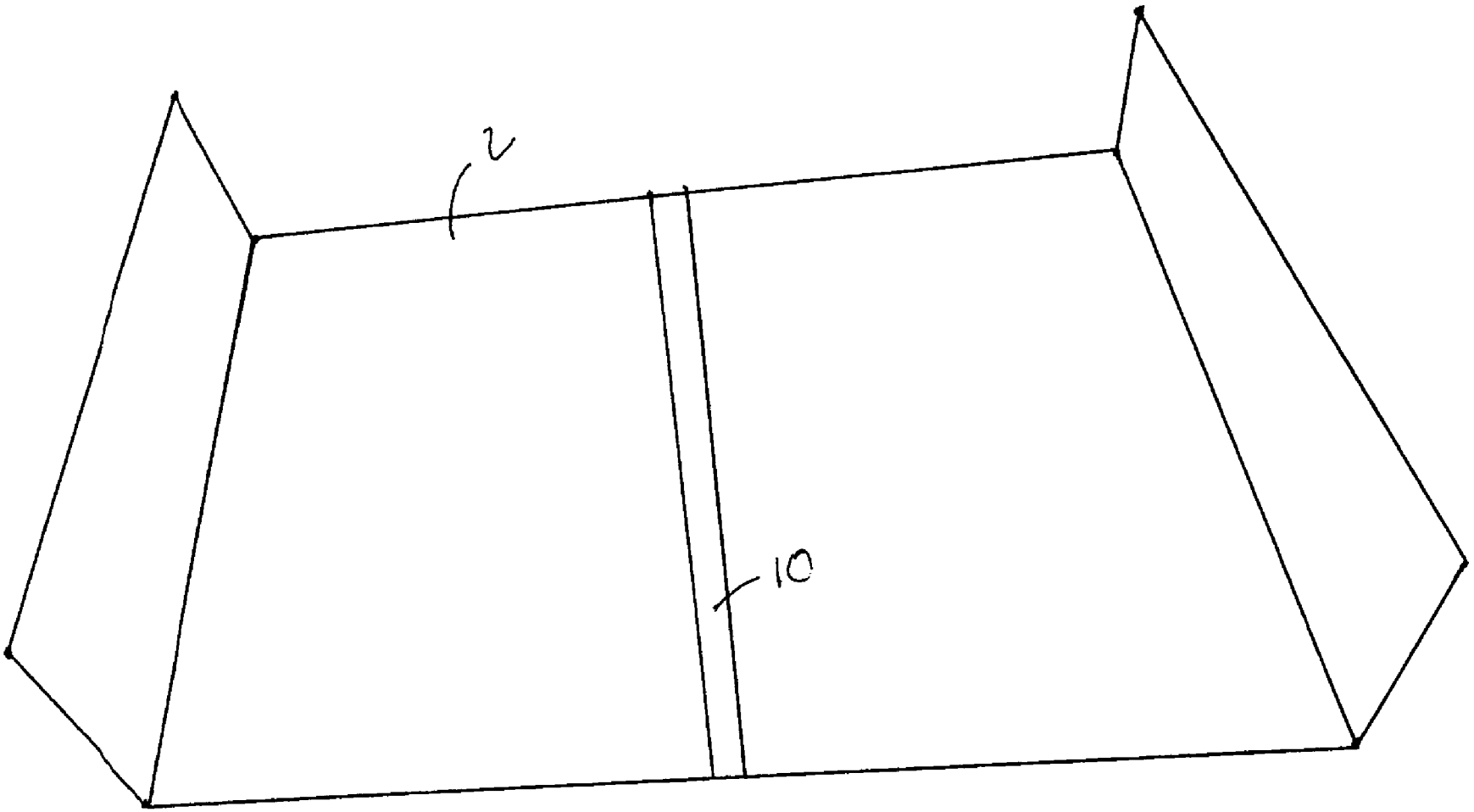
FIG. 3 illustrates the bottom side of fitted covering or that side of the covering adjacent to the mattress having a hook and loop assembly.

FIG. 3 depicts the bottom side of the fitted covering 2. The bottom side of the fitted covering 2 is that side which is adjacent to the mattress 14. The bottom side of the fitted covering 2 may include a hook and loop fastener 10. In an embodiment, one portion (loop for example) of the hook and loop fastener 10 may be attached to the bottom side of the fitted covering 2 and the other portion (hook for example) of the hook and loop fastener 10 is attached to the mattress 14 to secure the fitted covering 2 to the mattress 14.

Figure 4:
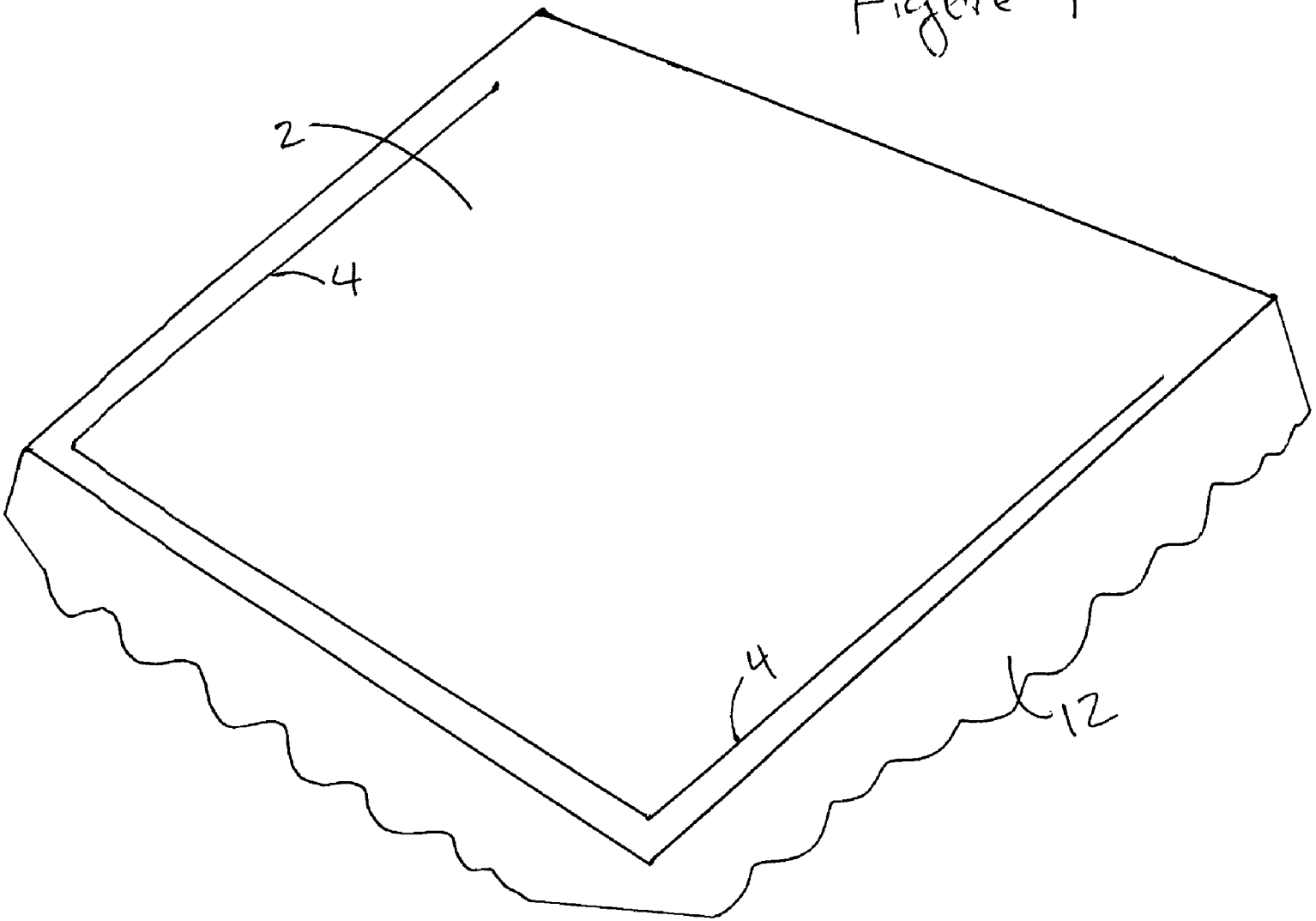
FIG. 4 depicts the fitted covering having a bed skirt in an embodiment of the present system for a removable bed covering.

FIG. 4 illustrates a further embodiment of the present system for a removable bed covering. In this embodiment the fitted covering 2 includes a bed skirt 12. Further illustrated is the first zipper assembly 4.

While applicants have set forth embodiments as illustrated and described above, it is recognized that variations may be made with respect to disclosed embodiments. Therefore, while the invention has been disclosed in various forms only, it will be obvious to those skilled in the art that many additions, deletions and modifications can be made without departing from the spirit and scope of this invention, and no undue limits should be imposed except as set forth in the following claims.

What is claimed is:

1. A removable bed covering system for a mattress having a head end comprising:

a fitted covering adapted to overlie the mattress;

a top covering adapted to overlie the fitted covering overlying the mattress;

a first zipper assembly securing the periphery of the fitted covering to the periphery of the top covering excluding the head end and forming an envelope there between, and wherein the top covering includes a second zipper assembly whereby the top covering can be converted into a sleeping bag by joining the peripheral ends of the top covering via the second zipper assembly.

2. The removable bed covering system of claim 1, wherein the second zipper assembly is located between about ⅛ to ½ inches from the first zipper assembly attached to the top covering.

3. The removable bed covering system of claim 2, wherein the second zipper assembly is located about ¼ of an inch from the first zipper assembly attached to the top covering.

4. The removable bed covering system of claim 1, wherein the second zipper assembly is a two sided zipper.

5. The removable bed covering system of claim 1, wherein the top covering and fitted covering include a design.

6. The removable bed covering system of claim 5, wherein the design of the top covering and fitted covering are the same whereby when the top covering is removed the bed continues to have an attractive appearance.

7. The removable bed covering system of claim 1, further including a bed skirt attached to the fitted covering.

8. The removable bed covering system of claim 1, further including a hook and loop fastener attached to the fitted covering, wherein the fastener secures the fitted covering to the mattress.

9. The removable bed covering system of claim 1, wherein the first zipper assembly is a two sided zipper.

10. A removable bed covering system for a mattress having a head end comprising:

a fitted covering adapted to overlie the mattress, the fitted covering includes a hook and loop fastener whereby the fastener secures the covering to the mattress and the fitted covering including a bed skirt;

a top covering adapted to overlie the fitted covering overlying the mattress;

a first zipper assembly securing the periphery of the fitted covering to the periphery of the top covering excluding the head end and forming an envelope there between; and a second zipper assembly attached to the top covering whereby the top covering can be converted into a sleeping bag by joining the peripheral ends of the top covering via the second zipper assembly.

11. The removable bed covering system of claim 10, further including pillow case, sham and bed skirt having the same design as the top covering and fitted covering.

12. The removable bed covering system of claim 10, wherein the second zipper assembly is located between about ⅛ to ½ inches from the first zipper assembly attached to the top covering.

13. The removable bed covering system of claim 12, wherein the second zipper assembly is located about ¼ of an inch from the first zipper assembly attached to the top covering.

14. The removable bed covering system of claim 11, wherein the second zipper assembly is a two sided zipper.

15. A removable bed covering system for a mattress having a head end comprising:

a fitted covering adapted to overlie the mattress, the fitted covering includes a hook and loop fastener whereby the fastener secures the fitted covering to the mattress;

a top covering adapted to overlie the fitted covering overlying the mattress, a first zipper assembly securing the periphery of the fitted covering to the periphery of the top covering excluding the head end and forming an envelope there between; and a second zipper assembly attached to the top covering whereby the top covering can be converted into a sleeping bag by joining the peripheral ends of the top covering via the second zipper assembly and wherein the second zipper assembly is a two sided zipper and is located between about ⅛ to ½ inches from the first zipper assembly attached to the top covering.

16. The removable bed covering system of claim 15, wherein the second zipper assembly is located about ¼ of an inch from the first zipper assembly attached to the top covering.

17. The removable bed covering system of claim 15, wherein the design of the top covering and fitted covering are the same whereby when the top covering is removed the bed continues to have an attractive appearance.

18. The removable bed covering system of claim 17, further including a pillow case, sham, and bed skirt having the same design as the top covering and fitted covering.

19. The removable bed covering system of claim 15, wherein the first zipper assembly is a two sided zipper.

* * * * *